US006425417B1

(12) United States Patent
Paschke

(10) Patent No.: US 6,425,417 B1
(45) Date of Patent: Jul. 30, 2002

(54) FABRIC AIR DUCT HELD IN TENSION

(75) Inventor: Nicholas B. Paschke, Milwaukee, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/705,009

(22) Filed: Nov. 2, 2000

(51) Int. Cl.[7] ..... F16L 3/00

(52) U.S. Cl. ..... 138/107; 138/106; 138/118; 248/61

(58) Field of Search ..... 138/107, 106, 138/118, 128; 248/61

(56) References Cited

U.S. PATENT DOCUMENTS

| | | | | | |
|---|---|---|---|---|---|
| 2,007,999 | A | * | 7/1935 | Brown | 138/107 |
| 2,013,724 | A | * | 9/1935 | Brady | 138/107 |
| 3,520,244 | A | * | 7/1970 | Gaines, Jr. | 138/107 X |
| 3,885,593 | A | * | 5/1975 | Koerber et al. | 138/107 X |
| 4,625,631 | A | * | 12/1986 | Vera | 248/61 X |
| 4,944,973 | A | * | 7/1990 | Follette | 138/107 X |
| 5,137,057 | A | * | 8/1992 | Hummert, III | 138/107 |
| 5,226,456 | A | * | 7/1993 | Semak | 138/107 |
| 5,285,818 | A | * | 2/1994 | Hummert, III | 138/107 |
| 5,429,330 | A | * | 7/1995 | Bond et al. | 248/61 |
| 5,664,607 | A | * | 9/1997 | Van Wessenhove | 138/107 |
| 5,961,044 | A | * | 10/1999 | Dalbec et al. | 239/77 |

FOREIGN PATENT DOCUMENTS

| | | | | |
|---|---|---|---|---|
| DE | 286851 | * | 2/1991 | 138/107 |

OTHER PUBLICATIONS

"Installation Instructions Models PFT–XD & PFT–XHD Air Control Duct," Berner International Corporation, May, 1996, 3 pages.

"Q–Duct Installation Instructions," Q–Duct Incorporated, Jun., 1999, 7 pages.

* cited by examiner

*Primary Examiner*—Patrick Brinson
(74) *Attorney, Agent, or Firm*—Marshall, Gerstein & Borun.

(57) ABSTRACT

An air duct assembly includes a flexible fabric duct for conveying and distributing a source of forced air to a room or other area of a building. The fabric duct is air permeable and/or includes discharge openings that evenly disperse the air into the room. When the source of forced air cycles on and off to meet the ventilating or conditioning demand of the area being served, the duct respectively inflates and deflates in response to changes in air pressure within the duct. To minimize noise created by the duct inflating suddenly, the duct is held in tension at all times. In some embodiments, the duct is held in resilient tension by a connector that couples a downstream end of the duct to an overhead cable from which the duct hangs. In some embodiments, a hoop attached to an end cap of the duct holds the end cap generally vertical.

20 Claims, 4 Drawing Sheets

FABRIC AIR DUCT HELD IN TENSION

BACKGROUND OF THE INVENTION

1. Field of the Invention

The subject invention generally pertains to air ducts and more specifically to a fabric air duct.

2. Description of Related Art

Ductwork is often used to convey conditioned air (e.g., heated, cooled, filtered, humidified, dehumidified, etc.) discharged from a fan and to distribute the air to a room or other areas within a building. Ducts are typically formed of sheet metal, such as steel, aluminum, or stainless steel. In many installations, ducts are hidden above suspended ceilings for convenience and aesthetics. But in warehouses, manufacturing plants and many other buildings, the ducts are suspended from the roof of the building and are thus exposed. In those warehouse or manufacturing environments where prevention of airborne contamination of the inventory is critical, metal ducts can create problems.

For example, temperature variations in the building, or temperature differentials between the ducts and the air being conveyed can create condensation on both the interior and exterior of the ducts. The presence of condensed moisture on the interior of the duct may form mold or bacteria that the duct then passes onto the room or other areas being supplied with the conditioned air. In the case of exposed ducts, condensation on the exterior of the duct can drip onto the inventory or personnel below. The consequences of the dripping can range anywhere from a minor irritation to a dangerously slippery floor for the personnel, or complete destruction of the products it may drip on (especially in food-processing facilities).

Further, metal ducts with localized discharge registers have been known to create uncomfortable drafts and unbalanced localized heating or cooling within the building. In many food-processing facilities where the target temperature is 42 degrees Fahrenheit, a cold draft can be especially uncomfortable and possibly unhealthy.

Many of the above problems associated with metal ducts are overcome by the use of flexible fabric ducts, such as a DUCTSOX by the Frommelt Safety Products Corporation of Milwaukee, Wis. Such ducts typically have a flexible fabric wall that is porous and/or includes additional holes along its length for evenly dispersing air from within the duct into the room being conditioned or ventilated. Fabric ducts are often suspended from a horizontal cable or track by way of several connectors distributed along the length of the duct. The connectors may include snap-hooks, clips, rings, or other type of connector that can slide along the cable or track. The connectors preferably allow the fabric duct to be readily removed from its cable or track, so that the fabric duct can be cleaned.

When a fan or blower forces air through a fabric duct to supply the room with air, the pressure of the forced air tends to inflate the duct. This causes the fabric duct to expand radially and longitudinally to a generally cylindrical shape. When the ventilating or other conditioning demand of the room is satisfied, the blower is usually turned off, which allows the fabric duct to deflate, and thus retract radially and longitudinally. Depending on the application and material of the fabric, in some cases, a deflated fabric duct sags, which may create a poor appearance or interfere with whatever might be directly beneath the duct. If the duct inflates rapidly whenever the blower turns on, rapid expansion of the duct may create an objectionable snapping or popping sound as the duct suddenly becomes taut along its cable or track.

SUMMARY OF THE INVENTION

An air duct assembly disclosed herein includes a fabric duct that is held in tension along its length, even while the duct is deflated. Such a tensioned duct may exhibit a minimization of the noise associated with the sudden inflation of the duct. The aesthetics of a deflated duct may also be improved.

In some embodiments, the fabric duct hangs from an elongated support member, while a connector attached to the support member and the duct maintains the duct in tension.

In some embodiment, a spring force holds the fabric duct in tension.

In some embodiments, an air duct assembly includes a fabric duct having an upper portion that is held in greater tension than a lower portion of the duct to simplify the assembly.

In some embodiments, a fabric air duct is held in tension by a tensile force applied generally collinear with a longitudinal centerline of the duct, so that tension in the fabric is generally uniform throughout the duct.

In some embodiments, an upstream end of a fabric duct is attached to a generally stationary and relatively rigid sheet metal sleeve that counters a tensile force applied to a downstream end of the duct.

DESCRIPTION OF THE PREFERRED EMBODIMENT

Figure 1:
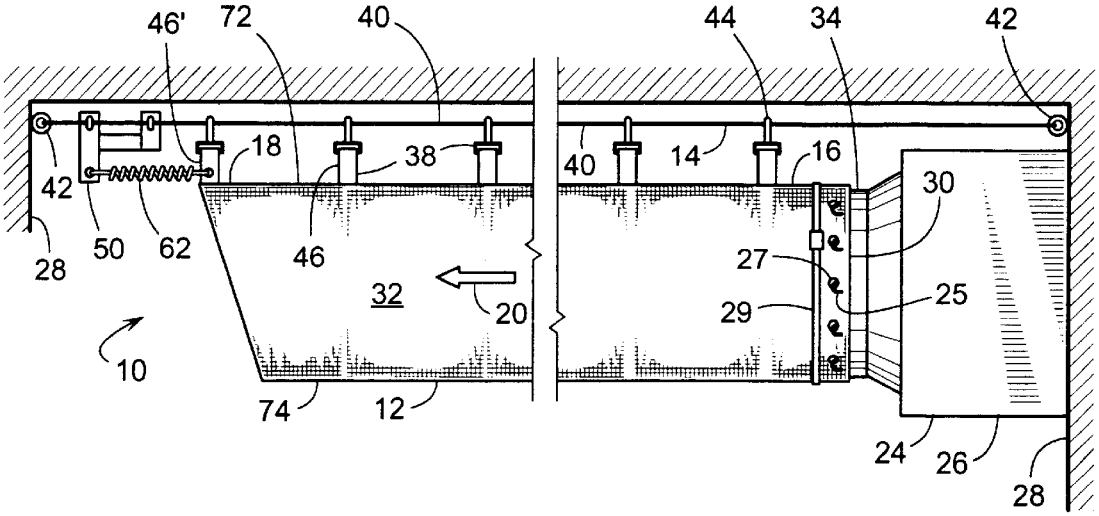
FIG. 1 is a side view of an air duct assembly showing part of its fabric covering turned back to further illustrate a radial and longitudinal seam of the fabric duct.

Air duct assembly 10, of FIGS. 1–4, is one example of a fabric air duct 12 that is suspended from an elongated support member 14 and is held in tension longitudinally between an upstream end 16 and a downstream end 18 of the duct. The terms, "upstream" and "downstream" are in reference to a normal direction 20 of airflow through an air duct. Upstream end 16 connects to a discharge outlet of a supply air duct or an air handler 24, such as a fan or blower disposed within a sheet metal housing 26. Forced air from air handler 24 (or from another source) pressurizes the interior of duct 12 from upstream end 16 to downstream end 18, so that duct 12 inflates to a generally cylindrical or tubular shape. Porosity and/or other openings in the duct's fabric allow the air within duct 12 to disperse into a room or area within a building 28 that is being ventilated or otherwise conditioned. The term, "fabric," refers to any pliable sheet of material that may or may not be air permeable or porous. Examples of a fabric include, but are not limited to, woven or knit cloth, flexible plastic sheeting that is not necessarily woven, plastic impregnated cloth, fiber reinforced plastic, and various combinations thereof.

To hold upstream end 16 fixed relative to air handler 24, a series of hooks 25 extending from a metal sleeve 34 (defining the discharge outlet of housing 26) hook into a series of eyelets 27 in upstream end 16 of duct 12. In addition, a strap clamp 29 can be used to help hold a fabric portion 32 of duct 12 tightly against sleeve 34. In alternate embodiments, other fasteners can be used, such as a VELCRO touch and hold fastener.

To suspend duct 12 from support member 14, several spaced hangers 38 can be distributed along the length of duct 12. The actual structure of hangers 38 and support member 14 can vary widely; however, in some embodiments, support member 14 comprises a stranded steel cable 40 held taut between two anchors 42, and each hanger 38 includes a snap-hook 44 that hooks onto cable 40 (see FIG. 3). Each hook 44 connects to duct 12 by way of a strap 46 that is sewn or otherwise attached to duct 12. Such a cable/hanger arrangement allows some manufacturing flexibility as to where straps 46 are attached along the length of duct 12, as hooks 44 can engage cable 40 almost anywhere along the length of cable 40.

Figure 2:
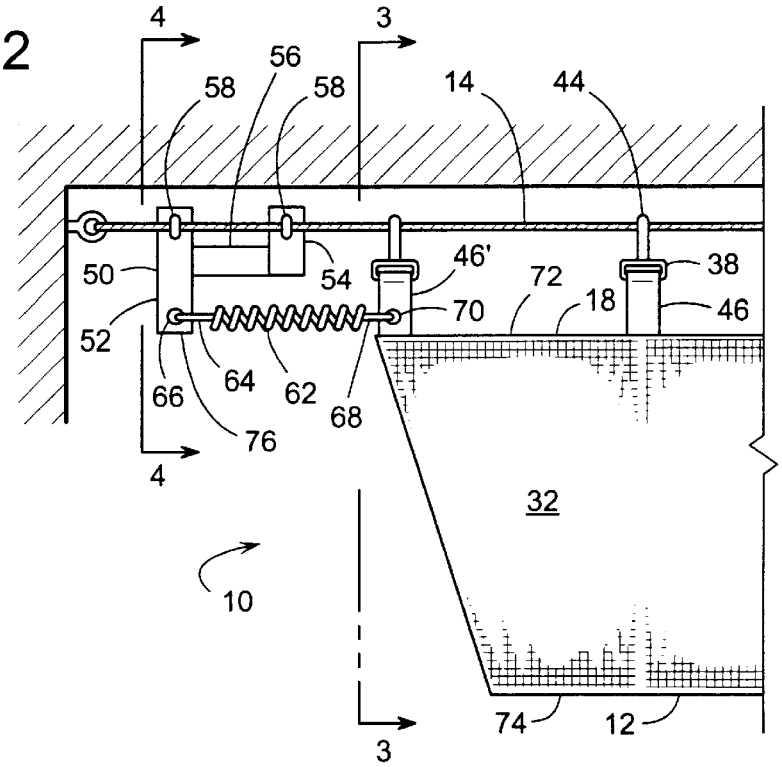
FIG. 2 is an enlarged partial side view of FIG. 1.
Figure 4:
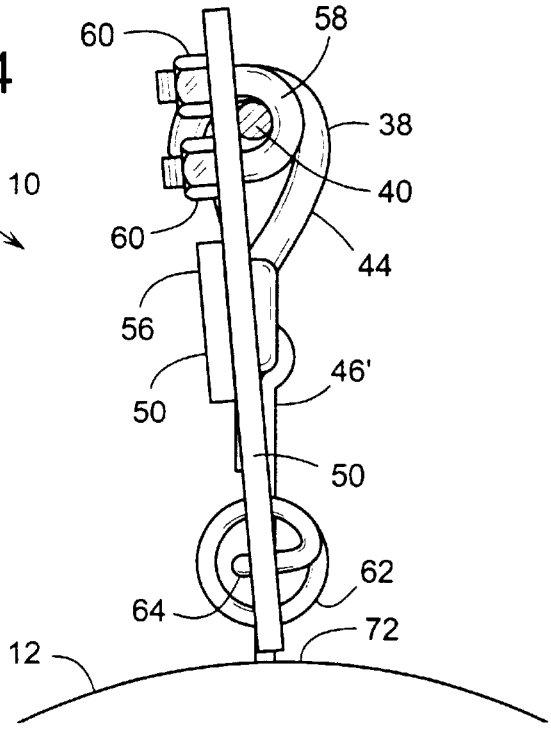
FIG. 4 is a cross-sectional view taken along line 4—4 of FIG. 2.
Figure 3:
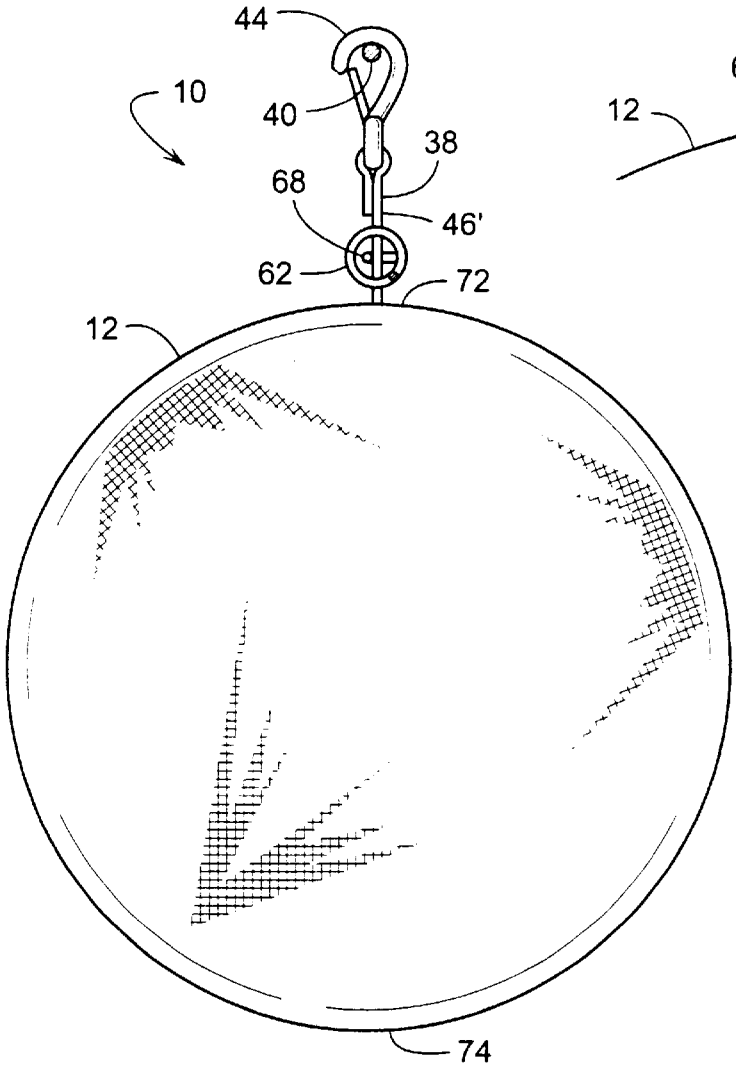
FIG. 3 is a cross-sectional view taken along line 3—3 of FIG. 2.

To reduce sagging when duct 12 is deflated and/or to reduce the noise that may be caused by duct 12 inflating suddenly, duct 12 is preferably held in tension even when deflated. Air duct assembly 10 accomplishes this with a connector 50 that resiliently couples downstream end 18 to cable 40. Connector 50 includes one generally fixed end plus a resilient member. For the fixed end, connector 50 includes two generally vertical bars 52 and 54, which are connected by a crossbar 56. A cable clamp 58, such as a U-bolt, attaches to each bar 52 and 54 by way of threaded nuts 60, thereby clamping connector 50 to cable 40 (see FIG. 4). However, variations of connector 50 provide a fixed end by simply attaching cable clamp 58 directly to cable 40. The direct connection eliminates the need for bars 52 and 54 and crossbar 56. A tension spring 62 stretched between one end 64 engaging a hole 66 in bar 52 (or attached directly to cable clamp 58 when bar 52 is eliminated) and an opposite end 68 engaging an eyelet 70 in one strap 46' provides the resilient member that maintains duct 12 in tension between downstream end 18 and upstream end 16. As can be seen in FIGS. 1 and 2, the tension along an upper portion 72 of duct 12 is greater than that of a lower portion 74. The stretch of spring 62 allows some leeway as to where connector 50 clamps onto cable 40 and maintains some tension in duct 12 even if the duct's length varies with varying air pressure inside duct 12. Crossbar 56 spaces clamps 58 apart, so that clamps 58 acting on two separated points along cable 40 can counter a rotational moment created by spring 62 pulling on a distal end 76 of bar 52.

Figure 5:
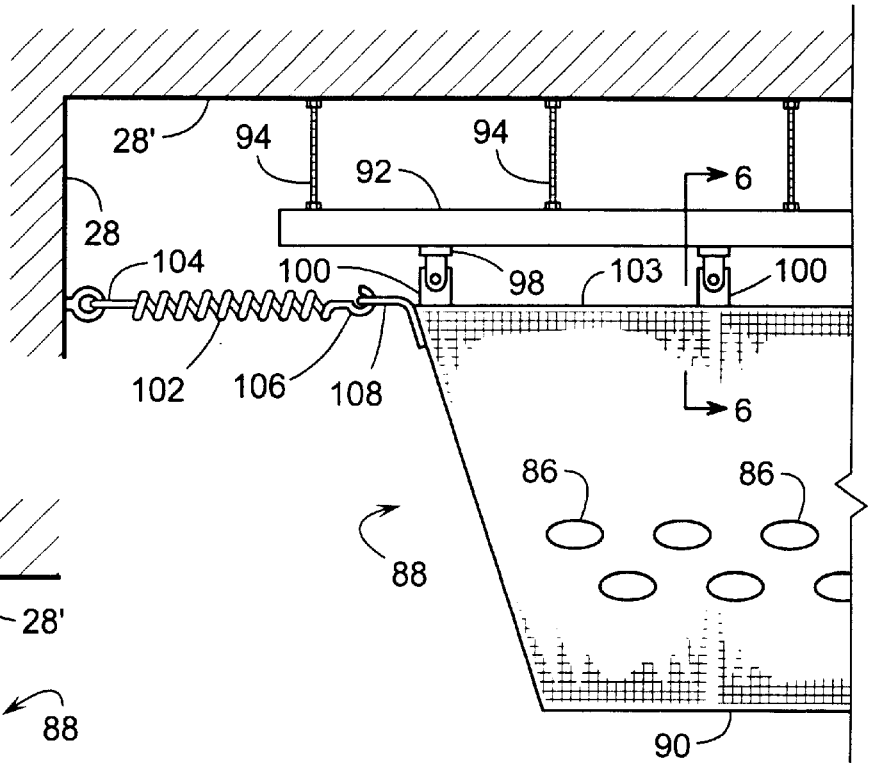
FIG. 5 is a partial side view similar to FIG. 2, but of another embodiment of an air duct assembly.
Figure 6:
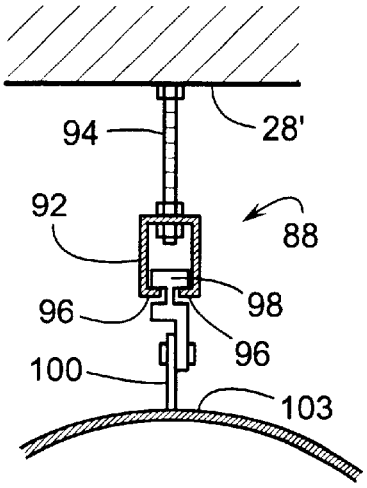
FIG. 6 is a cross-sectional view taken along line 6—6 of FIG. 5.

In another embodiment, shown in FIGS. 5 and 6, an air duct assembly 88 includes a duct 90 suspended from a track-style support member 92. A series of track hangers 94, such as cables or threaded rods, suspend support member 92 from a ceiling 28' or some other overhead structure of building 28, such as pipes or roof girders. Support member 92 can be extruded of aluminum to create a channel with horizontal flanges 96 that vertically support plastic couplings 98. Couplings 98 snap onto or otherwise attach to straps 100, which in turn are sewn or are otherwise attached to an upper portion 103 of duct 90. Duct assembly 88 includes a resilient connector 102 (e.g., spring, elastic cord, etc.) having one end 104 fixed relative to building 28 and an opposite end 106 attached to a tab 108 or some other feature of duct 90. Duct 90 also includes a series of holes 86 for delivering more airflow than what would be achieved by relying on fabric porosity alone.

Figure 7:
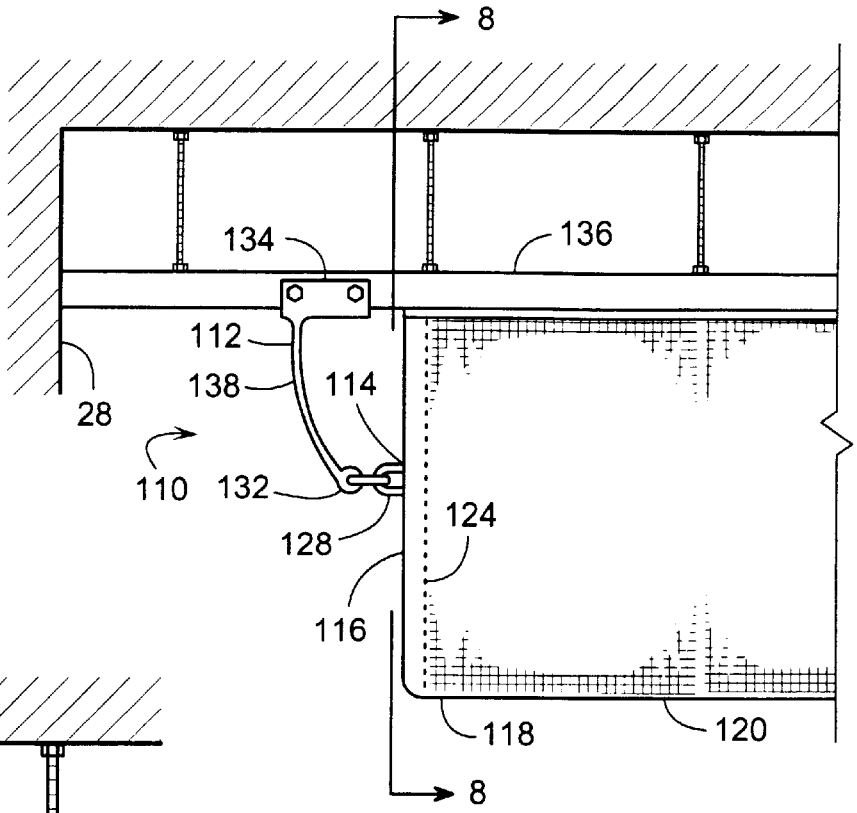
FIG. 7 is a partial side view similar to FIG. 2, but of another embodiment of an air duct assembly.
Figure 8:
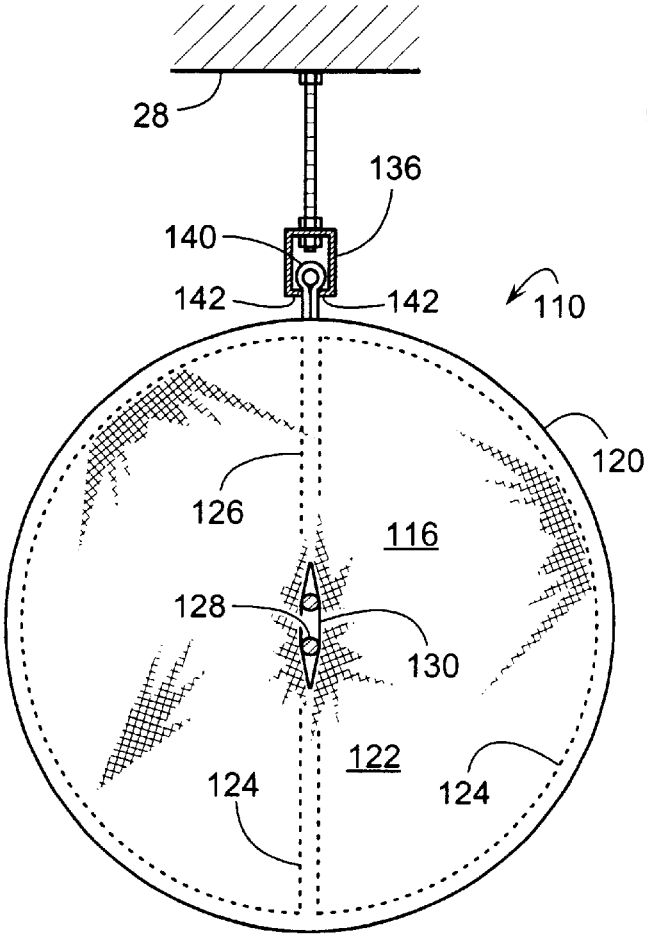
FIG. 8 is a cross-sectional end view taken along line 8—8 of FIG. 7.

To apply generally uniform tension to a duct, a duct assembly 110 includes a connector 112 that attaches to a central portion 114 of an end cap 116, which is disposed at a downstream end 118 of a duct 120, as shown in FIGS. 7 and 8. End cap 116 includes an air-permeable fabric covering 122 supported by a more rigid, annular frame 124 that holds end cap 116 generally vertical regardless of whether duct 120 is inflated. Frame 124 provides cap 116 with a generally circular shape whose perimeter is more rigid than covering 122. In some embodiments, frame 124 includes a crossbeam 126 with a central loop 128 that protrudes through an opening 130 in covering 122. Loop 128 couples end cap 116 to a distal end 132 of connector 112. An opposite end 134 of connector 112 attaches to a track-like support member 136 that is both horizontally and vertically supported relative to building 28. A resilient member in the form of arm 138, which extends between ends 132 and 134, is resiliently flexible to serve as a spring that helps maintain the tension in duct 120. Instead of couplings 98 and straps 100 of duct assembly 88, duct 120 includes an elongated bead 140 that is sewn along the length of duct 120. Bead 140 slides lengthwise into support member 136 and is vertically supported by horizontal flanges 142.

Figure 9:
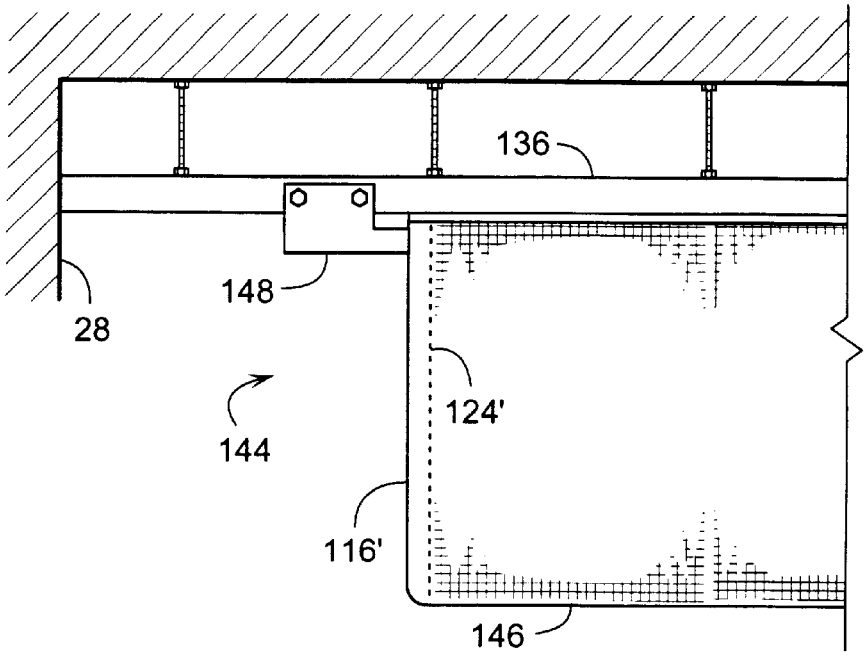
FIG. 9 is a partial side view similar to FIG. 2, but of another embodiment of an air duct assembly.

In another duct assembly 144, similar to assembly 110, a duct 146 of FIG. 9 includes an end cap 116' that is held generally vertical by a frame 124'. Frame 124' is similar to frame 124, but does not include loop 128. Instead, a rigid connector 148 is integrally and rigidly joined to an upper portion of frame 124'. End cap 116' includes an opening similar to opening 130, but sized and positioned to accommodate connector 148 instead of loop 128. Connector 148 attaches to support member 136 at a location that keeps duct 146 in tension. In further similarity to assembly 110, support member 136 supports duct 146 by engaging an elongated bead disposed along an upper portion of duct 146.

Although the invention is described with reference to a preferred embodiment, it should be appreciated by those skilled in the art that various modifications are well within the scope of the invention. Therefore, the scope of the invention is to be determined by reference to the claims that follow.

I claim:

1. An air duct assembly comprising:

an elongated support member;

a fabric duct suspended from the elongated support member and having an upstream end and a downstream end; and a connector coupled to the elongated support member and the downstream end to maintain the fabric duct in resilient tension between the upstream end and the downstream end regardless of whether air is being conveyed through the fabric duct.

2. The air duct assembly of claim 1, wherein the fabric duct includes an upper portion facing the elongated support member and a lower portion facing away from the elongated support member, wherein the upper portion is held in greater tension than the lower portion.

3. The air duct assembly of claim 1, wherein the connector includes a spring.

4. The air duct assembly of claim 1, wherein the fabric duct is porous.

5. The air duct assembly of claim 1, wherein the elongated support member comprises a channel and the fabric duct includes an elongated bead running from the upstream end to the downstream end and extending into the channel.

6. The air duct assembly of claim 1, wherein the elongated support member comprises a cable.

7. The air duct assembly of claim 1, further comprising a metal sleeve to which the upstream end of the fabric duct is anchored, whereby the fabric duct is held in tension between the downstream end and the metal sleeve.

8. The air duct assembly of claim 1, further comprising an end cap disposed at the downstream end of the fabric duct, wherein a perimeter of the end cap has greater rigidity than a fabric portion of the fabric duct.

9. The air duct assembly of claim 8, wherein the end cap is able to convey air therethrough.

10. The air duct assembly of claim 1, further comprising an end cap disposed at the downstream end of the fabric duct, wherein the connector is coupled to a central portion of the end cap and a perimeter of the end cap has greater rigidity than a fabric portion of the fabric duct.

11. An air duct assembly comprising:

an elongated support member;

a fabric duct suspended from the elongated support member and having an upstream end and a downstream end;

an end cap disposed at the downstream end of the fabric duct, wherein a perimeter of the end cap has greater rigidity than a fabric portion of the fabric duct; and a connector having one end substantially fixed and another end coupled to the perimeter of the end cap to maintain the fabric duct in tension between the upstream end and the downstream end.

12. The air duct assembly of claim 11, wherein the connector includes a resilient member to maintain the fabric duct in resilient tension.

13. The air duct assembly of claim 11, wherein the one end of the connector is attached to the elongated support member.

14. The air duct assembly of claim 11, wherein the elongated support member comprises a channel and the fabric duct includes an elongated bead running from the upstream end to the downstream end and extending into the channel.

15. The air duct assembly of claim 11, wherein the elongated support member comprises a cable.

16. The air duct assembly of claim 11, wherein the end cap is able to convey air therethrough.

17. The air duct assembly of claim 11, wherein the connector is coupled to a central portion of the end cap.

18. An air duct assembly comprising:

an elongated support member;

a fabric duct suspended from the elongated support member and having an upstream end and a downstream end;

an end cap disposed at the downstream end of the fabric duct, wherein a perimeter of the end cap has greater rigidity than a fabric portion of the fabric duct; and a connector having one end substantially fixed and another end coupled to the perimeter of the end cap, wherein the connector includes a resilient member that maintains the fabric duct in resilient tension between the upstream end and the downstream end.

19. The air duct assembly of claim 18, wherein the one end of the connector is attached to the elongated support member.

20. The air duct assembly of claim 18, wherein the connector is coupled to a central portion of the end cap.

* * * * *